US010662680B2

(12) United States Patent
Kim

(10) Patent No.: US 10,662,680 B2
(45) Date of Patent: May 26, 2020

(54) DOOR LOCKING DEVICE AND METHOD FOR PREVENTING DOOR FROM OPENING DURING SIDE COLLISION

(71) Applicants: HYUNDAI MOTOR COMPANY, Seoul (KR); KIA MOTORS CORPORATION, Seoul (KR)

(72) Inventor: Hang Mook Kim, Hwaseong-Si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 45 days.

(21) Appl. No.: 16/114,928

(22) Filed: Aug. 28, 2018

(65) Prior Publication Data

US 2018/0363335 A1 Dec. 20, 2018

Related U.S. Application Data

(62) Division of application No. 14/621,106, filed on Feb. 12, 2015, now Pat. No. 10,087,660.

(30) Foreign Application Priority Data

Oct. 17, 2014 (KR) ..... 10-2014-0140721

(51) Int. Cl.
*E05B 77/04* (2014.01)
*E05B 77/06* (2014.01)
*E05B 85/16* (2014.01)

(52) U.S. Cl.
CPC ..... *E05B 77/04* (2013.01); *E05B 77/06* (2013.01); *E05B 85/16* (2013.01)

(58) Field of Classification Search
CPC ..... E05B 77/06; E05B 85/16; E05B 85/10; E05B 77/04; E05B 77/02; E05B 13/002; Y10T 292/57; Y10S 292/22; Y10S 292/65
See application file for complete search history.

(56) References Cited

U.S. PATENT DOCUMENTS 3,719,248 A * 3/1973 Breitschwerdt ..... E05B 77/06 180/271
5,421,061 A 6/1995 Kolle et al.
6,007,122 A * 12/1999 Linder ..... E05B 85/10 292/216
6,042,159 A * 3/2000 Spitzley ..... E05B 77/06 16/111.1
7,097,216 B2 8/2006 Lane et al.
7,635,151 B2 12/2009 Rodawold, Jr. et al.
(Continued)

*Primary Examiner* — Mark A Williams
(74) *Attorney, Agent, or Firm* — Morgan, Lewis & Bockius LLP

(57) ABSTRACT

A door locking device for preventing a door from opening during a side collision comprises a base having one surface provided with an outside lever and another surface provided with a door latch to extend from the outside lever to contact an extending part which has a guide part extended through the base to be horizontal with the extending part. An inner side part of the guide part has a plurality of long grooves and a plurality of short grooves which are horizontal with the extending part. A rotator is inserted into the guide part and has a plurality of long ribs and a plurality of short ribs. A cap-shaped button has a bottom surface in contact with the plurality of long ribs. A blocking lever is linked to en upper end of the button and pivotably mounted in the base.

2 Claims, 11 Drawing Sheets

(56) References Cited

U.S. PATENT DOCUMENTS 8,746,758 B2 6/2014 Savant et al.
8,783,742 B2 * 7/2014 Puscas ..... E05B 77/06 292/336.3
2005/0184537 A1 * 8/2005 Le ..... E05B 77/06 292/336.3
2006/0038418 A1 2/2006 Huizenga et al.
2006/0049647 A1 3/2006 von zur Muehlen
2006/0255600 A1 * 11/2006 Belchine, III ..... E05B 17/0004 292/336.3
2007/0024068 A1 * 2/2007 Wood ..... E05B 77/06 292/336.3
2007/0080547 A1 * 4/2007 Lee ..... E05B 77/06 292/336.3
2007/0284894 A1 * 12/2007 Rodawold ..... E05B 77/06 292/336.3
2008/0136199 A1 * 6/2008 Kim ..... E05B 77/06 292/340
2009/0085360 A1 * 4/2009 Bertolotti ..... E05B 77/06 292/336.3
2009/0102206 A1 * 4/2009 Lee ..... E05B 77/06 292/336.3
2010/0225127 A1 * 9/2010 Muller ..... E05B 77/06 292/336.3
2010/0237633 A1 * 9/2010 Jankowski ..... E05B 77/06 292/216
2011/0115240 A1 * 5/2011 Muller ..... E05B 77/06 292/336.3
2011/0120022 A1 * 5/2011 Papanikolaou ..... E05B 77/06 49/460
2011/0156412 A1 * 6/2011 Savant ..... E05B 77/06 292/336.3
2011/0163554 A1 * 7/2011 Patel ..... E05B 77/06 292/216
2013/0187394 A1 * 7/2013 Lesueur ..... E05B 77/06 292/336.3
2013/0233034 A1 9/2013 Ono et al.
2014/0292005 A1 * 10/2014 Bendel ..... E05B 77/06 292/336.3
2014/0312633 A1 * 10/2014 Ilardo ..... E05B 77/06 292/336.3
2014/0361556 A1 * 12/2014 Beck ..... E05B 77/06 292/336.3
2014/0367977 A1 * 12/2014 Beck ..... E05B 85/14 292/336.3
2014/0375068 A1 * 12/2014 Niegeloh ..... E05B 7/00 292/336.3
2014/0375069 A1 * 12/2014 Niegeloh ..... E05B 85/16 292/336.3
2015/0042111 A1 * 2/2015 Ichikawa ..... E05B 77/06 292/336.3
2015/0054295 A1 * 2/2015 Nam ..... E05B 77/06 292/336.3
2015/0069767 A1 * 3/2015 Nam ..... E05B 77/06 292/336.3
2015/0123410 A1 * 5/2015 Kang ..... E05B 77/04 292/336.3
2015/0184431 A1 * 7/2015 Da Deppo ..... E05B 85/10 292/336.3
2015/0191942 A1 * 7/2015 Ilardo ..... E05B 77/06 292/336.3
2015/0225987 A1 * 8/2015 Frattini ..... E05B 81/78 292/336.3
2015/0322699 A1 * 11/2015 Ilardo ..... E05B 77/06 292/336.3
2015/0345188 A1 * 12/2015 Puscas ..... E05B 85/14 292/336.3
2016/0001643 A1 * 1/2016 Ichikawa ..... E05B 79/20 49/352
2016/0060913 A1 * 3/2016 Kim ..... E05B 79/22 292/336.3
2016/0130845 A1 * 5/2016 Park ..... E05B 77/06 292/336.3

* cited by examiner

<PRIOR ART>

<PRIOR ART>

<PRIOR ART>

FIG.5A
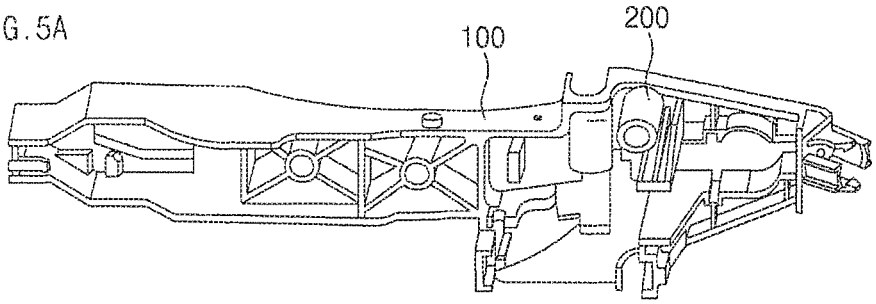
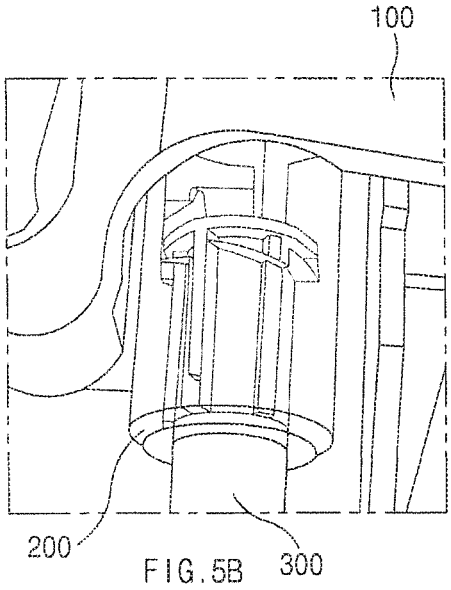
FIG.5B
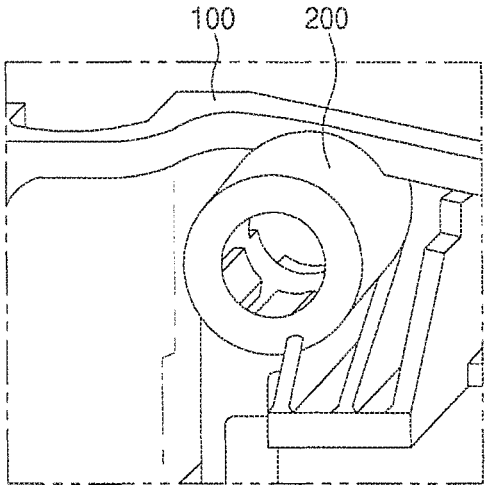
FIG.5C
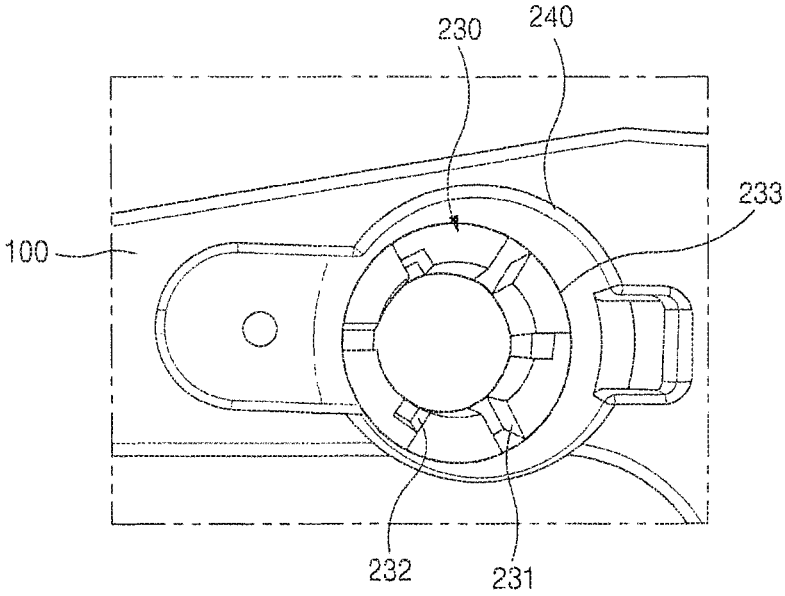
FIG.5D

DOOR LOCKING DEVICE AND METHOD FOR PREVENTING DOOR FROM OPENING DURING SIDE COLLISION

CROSS-REFERENCE TO RELATED APPLICATION

This application is a Divisional Application of U.S. patent application Ser. No. 14/621,106, filed Feb. 12, 2015, which claims the benefit of priority to Korean Patent Application No. 10-2014-0140721, filed on Oct. 17, 2014, the disclosures of which are incorporated herein in their entirety by reference.

TECHNICAL FIELD

The present disclosure relates to a door locking device and a method for preventing a door from opening during a side collision, and more particularly, to a door locking device and a method for preventing a door from opening due to external shocks.

BACKGROUND

Generally, a vehicle is provided with an outside lever and an inside lever for opening and closing a door at outside and inside the door. A door latch assembly for locking or unlocking the door by operating the outside lever and the inside lever is provided inside a door panel.

The outside lever is unintentionally operated by an inertial force during a side collision of the door, thus, opening the door. Therefore, a need exists to prevent a door from being opened during the side collision.

According to the related art as illustrated in FIGS. 1A-1C, a blocking lever 2 is mounted at an inner side part of an outside lever 1 to prevent a door from being opened due to an inertial force during the collision. The blocking lever 2 rotates based on a reference point by an external force and is interposed between the inner side part of the outside lever 1 and a door latch 3 during the rotation to block a connection between the outside lever 1 and a door latch 3.

However, according to the existing blocking lever to prevent the door from being opened at the time of the side collision, when a difference between an operation time of the blocking lever and a pulling time of the outside lever occurs, the door may also be opened.

SUMMARY

The present disclosure has been made to solve the above-mentioned problems occurring in the prior art while advantages achieved by the prior art are maintained intact.

An aspect of the present inventive concept provides a door locking device and a method for preventing a door from opening during a side collision capable of preventing the door from being unintentionally opened during the side collision by fixing an operating blocking lever.

According to an exemplary embodiment of the present inventive concept, a door locking device for preventing a door from opening during a side collision includes a base having an outside lever mounted on a first surface of the base and a door latch mounted on a second surface of the base to contact an extending part protruding on the second surface of the base. A guide part passes through the base and is parallel with the extending part. The guide part has an inner side part provided with a plurality of long grooves and a plurality of short grooves disposed in a longitudinal direction of the guide part, and an internal area having an inner diameter larger than that of the inner side part. A rotator is inserted into the amide part and has a plurality of long ribs inserted into the long grooves and a plurality of short ribs inserted into the short grooves, respectively. A cap-shaped button has a first bottom surface contacting the plurality of long ribs and has the rotator inserted into the cape-shaped button. The cap-shaped button has a continuous cam surface, which has a regularly varying height and a triangular wave shape, on the first bottom surface. A blocking lever is connected to a first upper end of the cap-shaped button and pivotably mounted to the base. A second upper end of the long rib is slanted and adheres to the continuous cam surface of the cap-shaped button, and a third upper end of the short rib has the same shape as the second upper end.

According to another exemplary embodiment of the present inventive concept, a method for preventing a door from opening during a side collision of a vehicle having a door locking device including a base provided with an outside lever opening and closing the door of the vehicle and a door latch operated by the outside lever, a button linked with a blocking lever restricting an operation of the door latch, and a rotator mounted in the base to rotate by the button includes pressing, by the button, the rotator toward the cover due to external shocks. A long rib formed in the rotator is separated from a long groove. The rotator rotates while an upper end of the long rib slides along a continuous cam surface formed on a bottom surface of the button. The button is restricted to the rotator while the upper end of the long rib is fastened with a short groove, and the blocking lever is interposed between an extending part and the door latch.

According to still another exemplary embodiment of the present inventive concept, a door locking device for preventing a door from opening during a side collision comprises a base provided with an outside lever which opens and closes the door of a vehicle and a door latch operated by the outside lever. A guide part passes through the base and includes: an inner side part on which a plurality of long grooves and a plurality of short grooves are alternatively disposed in a longitudinal direction of the guide part; and an internal area having an inner diameter larger than that of the inner side part. A button is linked with a blocking lever which restricts an operation of the door latch. The button has a continuous cam surface, which has a regularly varying height and a triangular wave shape, on a bottom surface of the button. A rotator is mounted in the base to rotate by the button. The rotator has a plurality of long ribs inserted into the long grooves and a plurality of short ribs inserted into the short grooves. An upper end of each of the long ribs is slanted and adheres to the continuous cam surface of the cap-shaped button, and an upper end of each of the short ribs has the same shape as the upper end of each of the long ribs. The rotator moves in a longitudinal direction along the button in response to movement of the button. The rotator rotates along bottom surface which is formed at an inner side of the base. The rotator is formed on and fixed by the inner bottom surface.

BRIEF DESCRIPTION OF THE DRAWINGS

The move and other objects, features and advantages of the present disclosure will be more apparent from the following detailed description taken in conjunction with the accompanying drawings.

FIGS. 5A-5D are perspective views of a base which is equipped in the door locking device for preventing a door from opening during the side collision of FIG. 2 and a perspective view of a main part of the base.

DETAILED DESCRIPTION

Figure 1C:
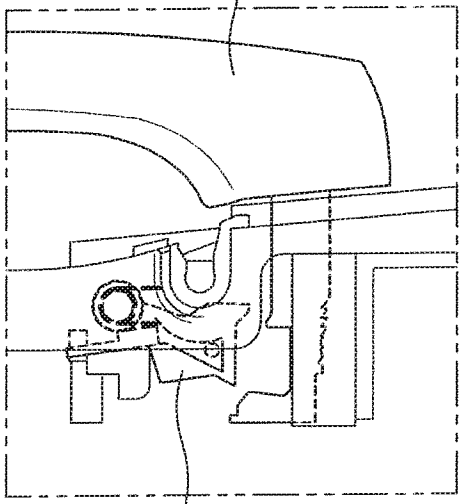
FIGS. 1A-1C are perspective views of the existing blocking lever provided between an outside lever and a door latch and an exemplified view of an operation of the existing blocking lever.
Figure 1B:
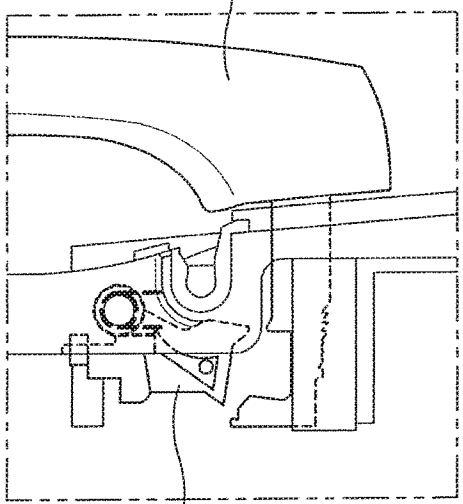
Figure 1A:
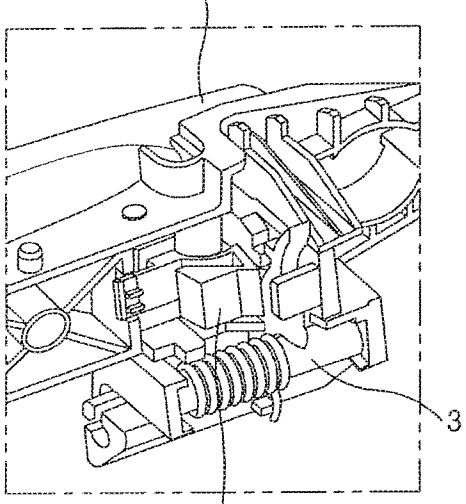
Figure 2:
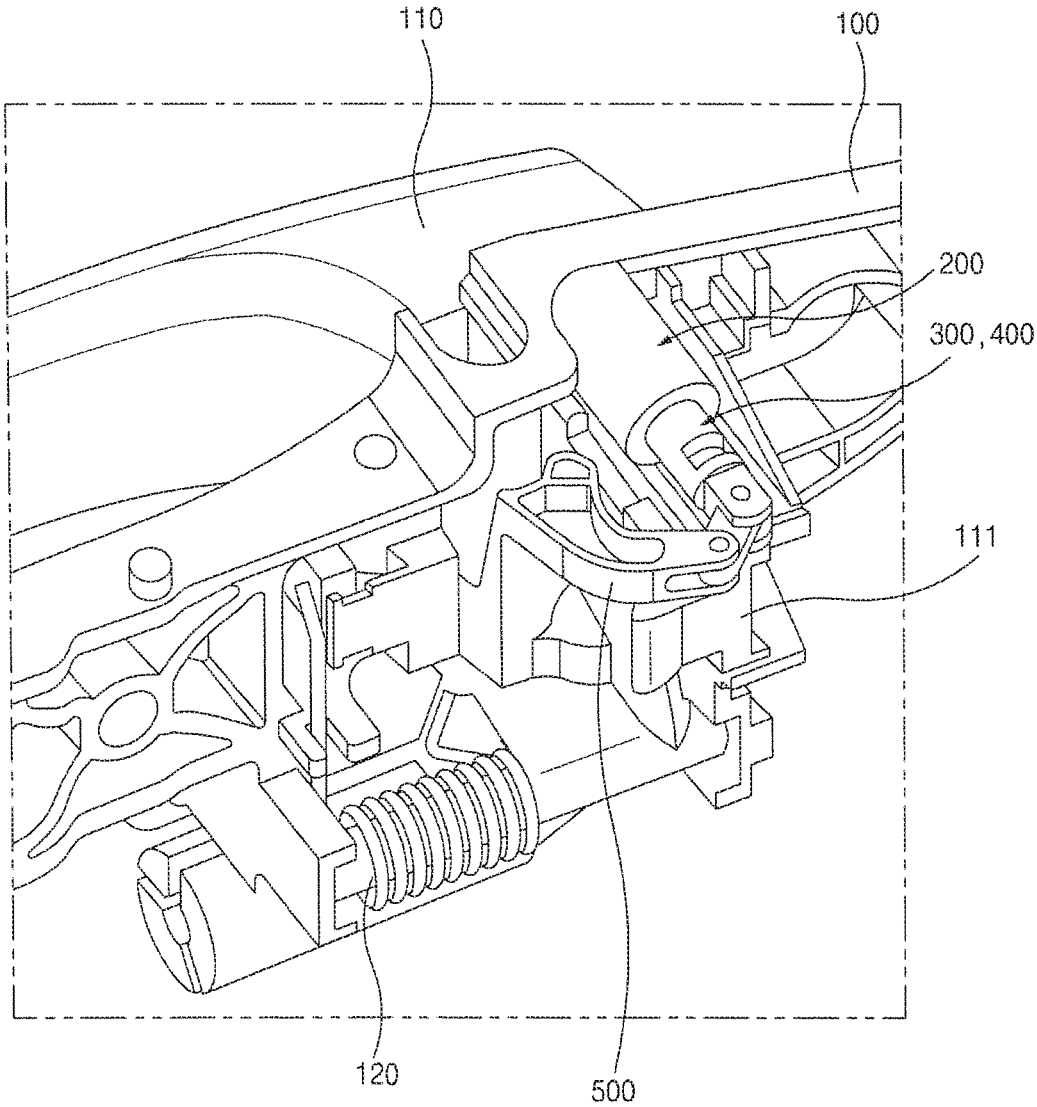
FIG. 2 is a perspective view of a door locking device for preventing a door from opening during a side collision according to an exemplary embodiment of the present inventive concept.
Figure 3:
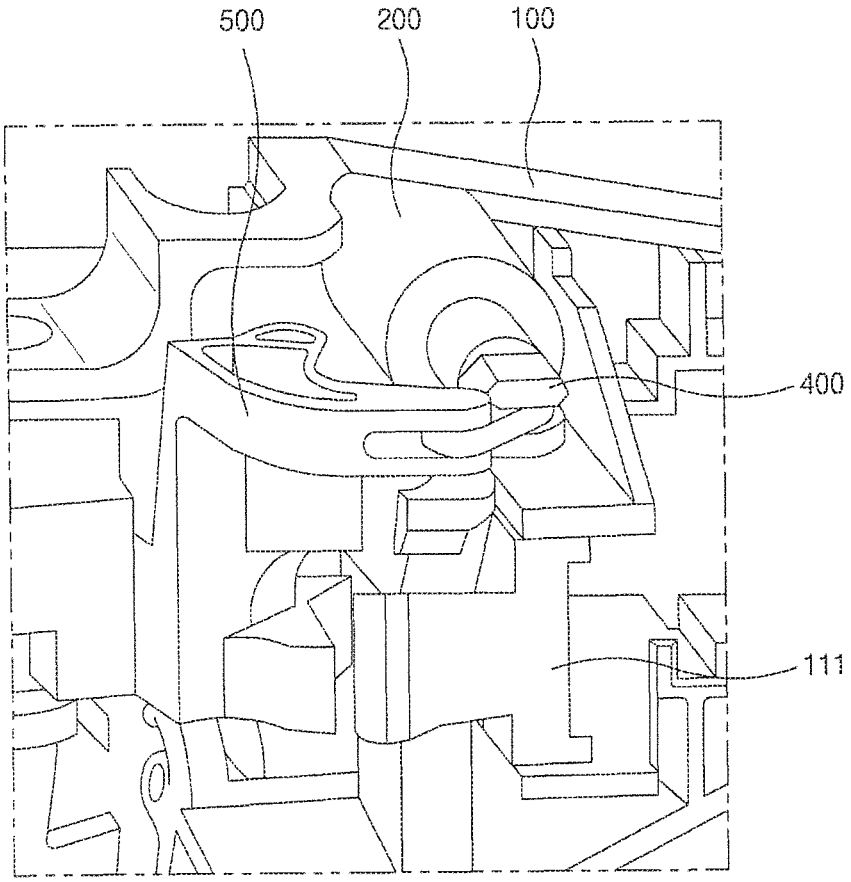
FIG. 3 is another perspective view of a door locking device for preventing a door from opening during the side collision of FIG. 2.
Figure 4:
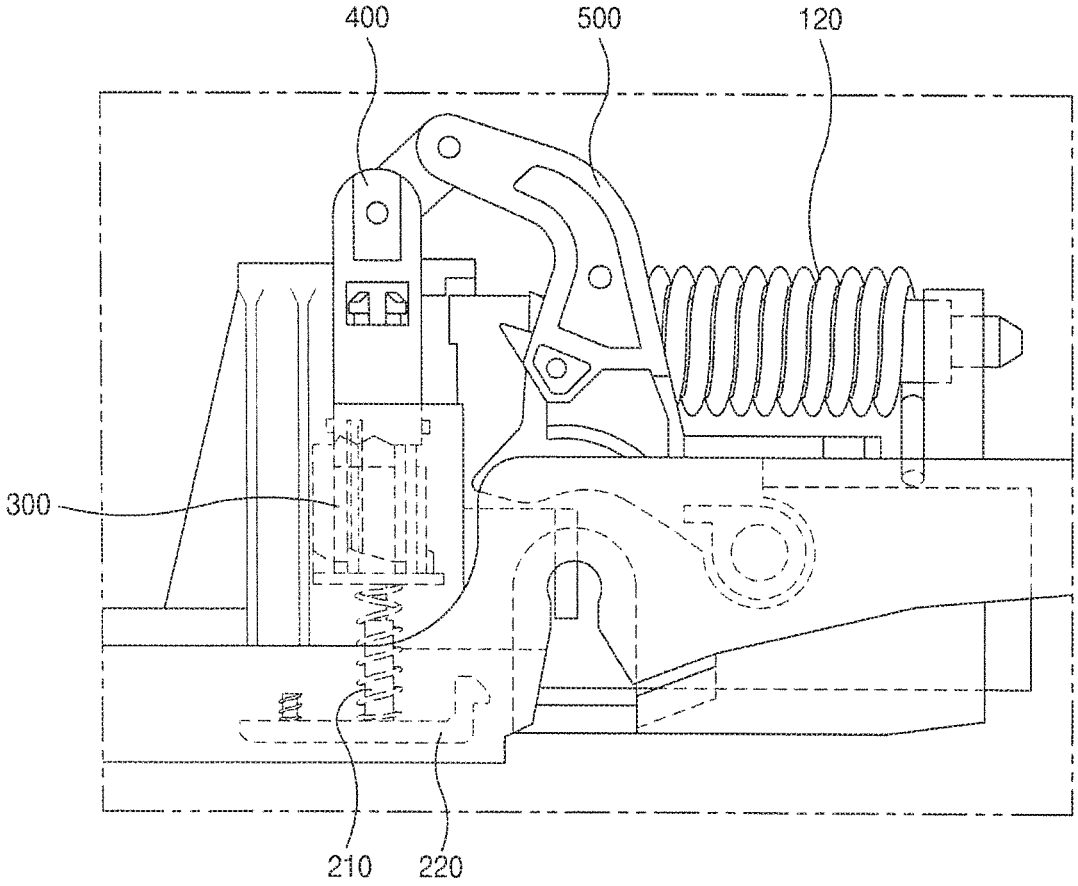
FIG. 4 is a plan view of the door locking device for preventing a door from opening during the side collision of FIG. 2.
Figure 6A:
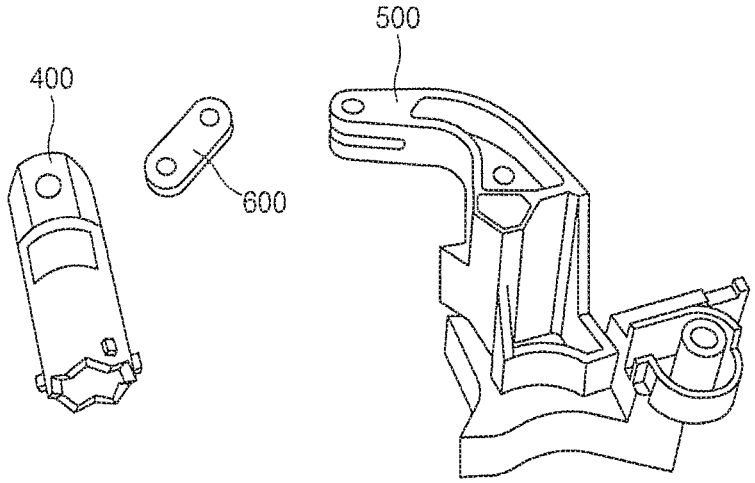
FIGS. 6A-6H are perspective views of a rotator, a button, and a blocking lever which are mounted in the door locking device for preventing a door from opening during the side collision of FIG. 2.
Figure 6B:
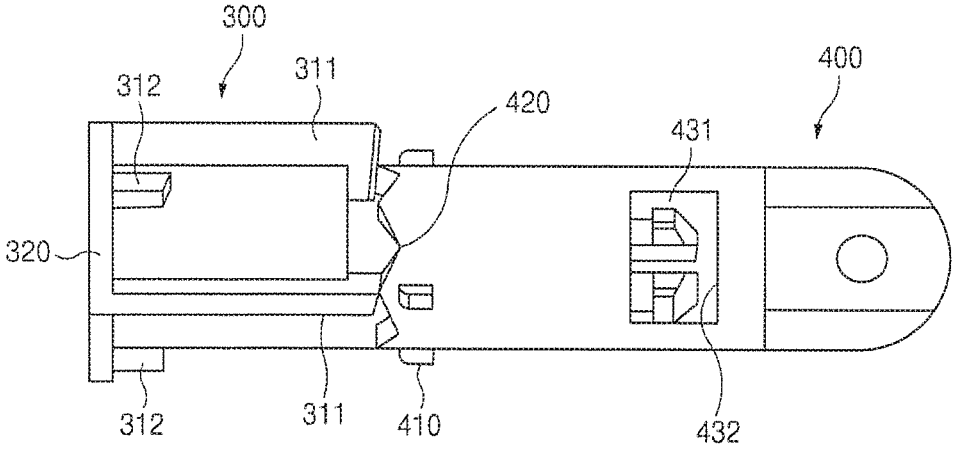
Figure 6C:
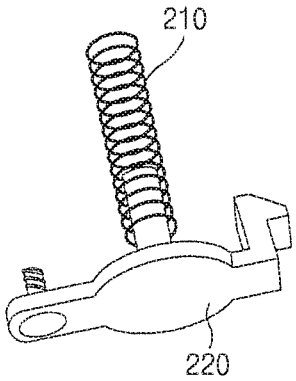
Figure 6D:
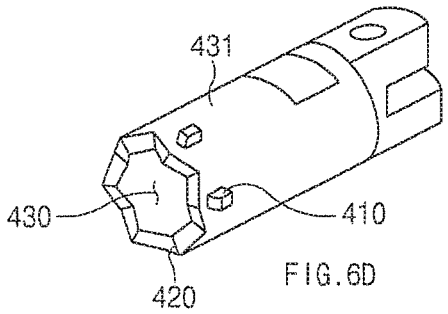
Figure 6E:
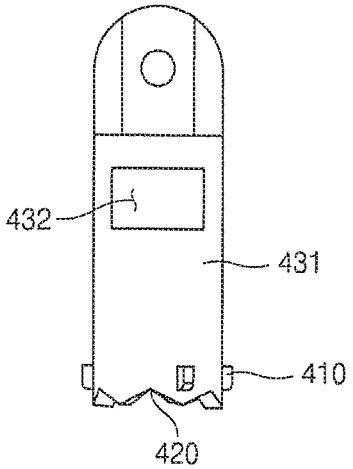
Figure 6F:
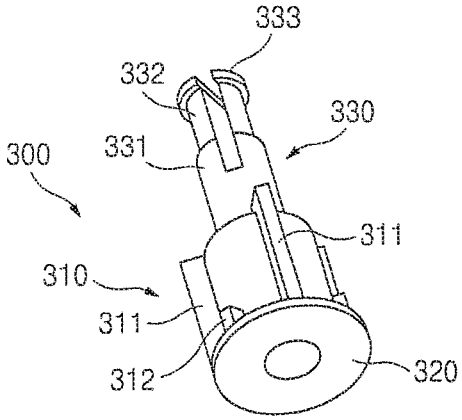
Figure 6G:
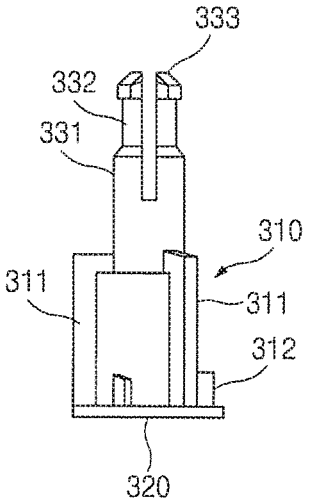
Figure 6H:
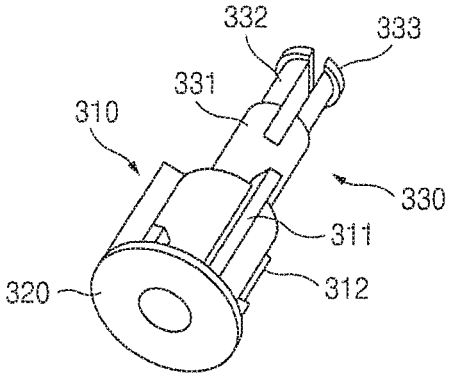
Figure 7A:
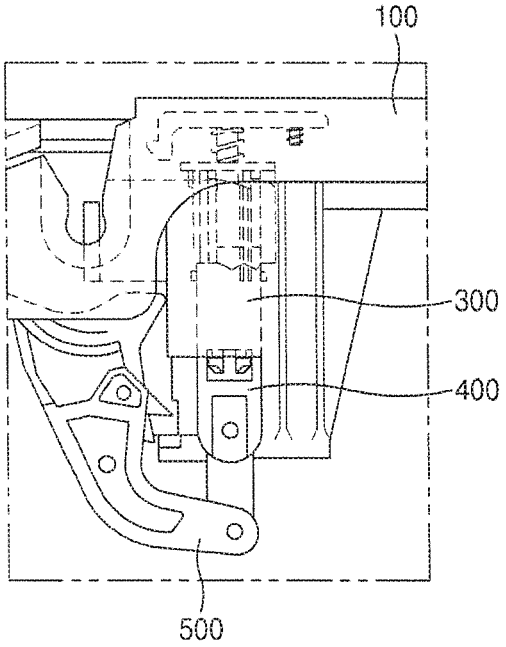
FIGS. 7A-7D exemplified views of the button and the rotator which are mounted in the door locking device for preventing a door from opening during the side collision of FIG. 2.
Figure 7B:
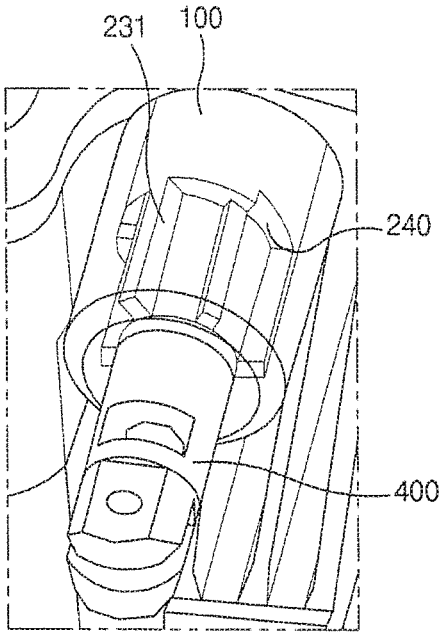
Figure 7C:
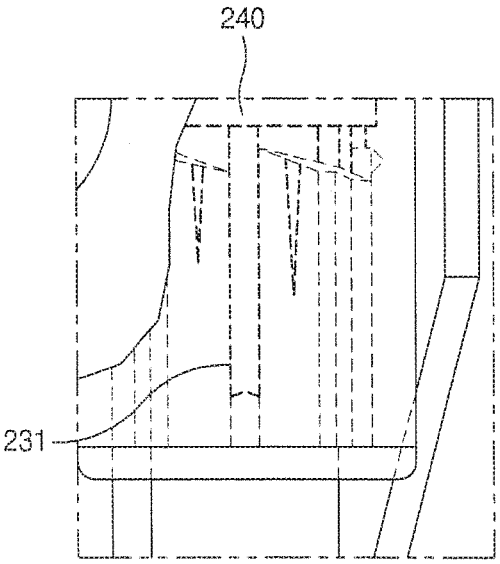
Figure 7D:
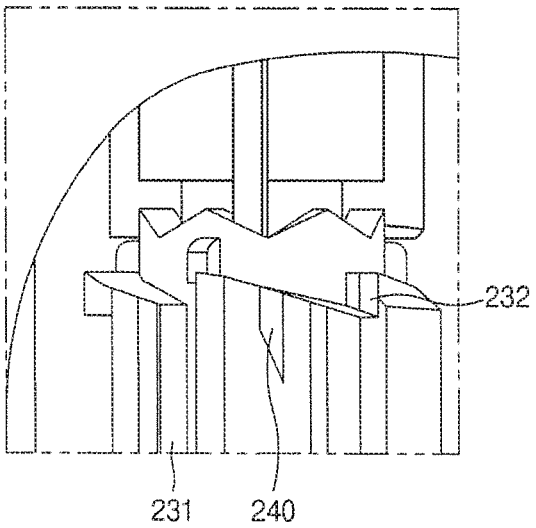

Exemplary embodiments of the present inventive concept will be described in detail with reference to the accompanying drawings.

Referring to FIGS. 2 to 6C, a door locking device for preventing a door from opening during a side collision according to an exemplary embodiment of the present inventive concept includes a base 100 configured to have one surface provided with an outside lever 110 and another surface provided with a door latch 120 to extend from the outside lever 110 to contact an extending part 111 protruding on the other surface. A guide part 200, which passes through the base 100 and is horizontal with the extending part 111, has an inner side part 230 having a plurality of long grooves 231 and a plurality of short grooves 232 which are horizontal with the extending part 111. A rotator 300 is inserted into the guide part 200 and has a plurality of long ribs 311 inserted into the long grooves 231 and a plurality of short ribs 312 inserted into the short grooves 232. A cap-shaped button 400 has a bottom surface in contact with the plurality of long ribs 311 and has the rotator 300 inserted thereinto. A blocking lever 500 is linked to an upper end of the button 400 and pivotably mounted in the base 100.

The guide part 200 includes a spring 210 pressing the rotator 300 toward the door latch 120, and a cover 220 supporting the spring 210 and stopping an opened side of the outside lever 110.

Further, as illustrated in FIGS. 5A-5D, the guide part 200 includes an inner side part 230 having the long grooves 231 and the short grooves 232 formed along a longitudinal direction thereof, and an internal area 240 having an inner diameter larger than that of the inner side part 230.

The inner side part 230 includes an inner bottom surface 233 protruding in a saw-tooth shape toward the internal area 240 and has the long grooves 231 formed from a maximum protruding point of the inner bottom surface 233 toward an opposite direction to the inner bottom surface 233.

As illustrated in FIGS. 6A-7D, the rotator 300 includes a moving body part 310 movable in the inner side part 230 and the internal area 240, and has the long ribs 311 and the short ribs 312 formed along a longitudinal direction from a bottom surface of the main body part 310. A flange 320 has the same diameter as that of the inner side part 230 and is formed on the bottom surface of the moving body part 310, and an insertion part 330 is inserted into the button 400.

The insertion part 330 includes an insertion extending part 331 extending from the moving body part 310 and having a diameter smaller than that of the moving body part 310. A fastening part 332 extends from the insertion extending part 331 and has a diameter smaller than that of the insertion extending part 331. A seating part 333 is formed at an upper end of the fastening part 332 and has the same diameter as that of the insertion extending part 331.

The button 400 has the same outer diameter as the inner diameter of the inner side part 230 and includes a plurality of protrusions 410 provided at an outer side of the inner side part 230 to move along the long grooves 231 of the inner side part 230. A continuous cam surface 420 is formed on a bottom surface of the button 400 in a triangular wave shape and has a regularly varying height. An internal receiving part 430 has the insertion part 330 inserted thereinto.

The internal receiving part 430 includes an internal ring type protrusion 431 having a seating part 333 seated therein and the same diameter as that of the insertion extending part 331 and an opening part 432 formed in the button 400 so that the seating part 333 is visible from outside.

The upper end of the long rib 311 is obliquely formed and adheres to the continuous cam surface 420 which is formed on the bottom surface of the button 400, and the upper end of the short rib 312 has the same shape as the upper end of the long rib 311.

A connection link 600 which has both ends each hinged with the button 400, and the blocking lever 500 is provided between the button 400 and the blocking lever 500. The blocking lever 500 is mounted in the base 100 through a pin. A rotation of the blocking lever 500 is delivered to the button 400 through the connection link 600.

The button 400 linearly moves along the long groove 231 which is formed in the base 100. The rotator 300 linearly moves along the long groove 231 which is formed in the base 100. When the long rib 311 formed in the rotator 300 is separated from the long groove 231, the rotator 300 rotates along the continuous cam surface 420 which is formed on the bottom surface of the button 400. The cover 220 is screwed into the base 100.

According to the door locking device for preventing a door from opening during a side collision configured as described above, when the external force is applied, the blocking lever 500 first rotates to prevent the outside lever 110 from moving in a door opening direction. In this case, the rotator 300 is locked in the base 100, and thus, a position of the blocking lever 500 is fixed. Next, by the intended operation of the outside lever 110, the locked rotator 300 is released, and thus, the blocking lever 500 may rotate. A detailed description thereof will be provided below.

Figure 8:
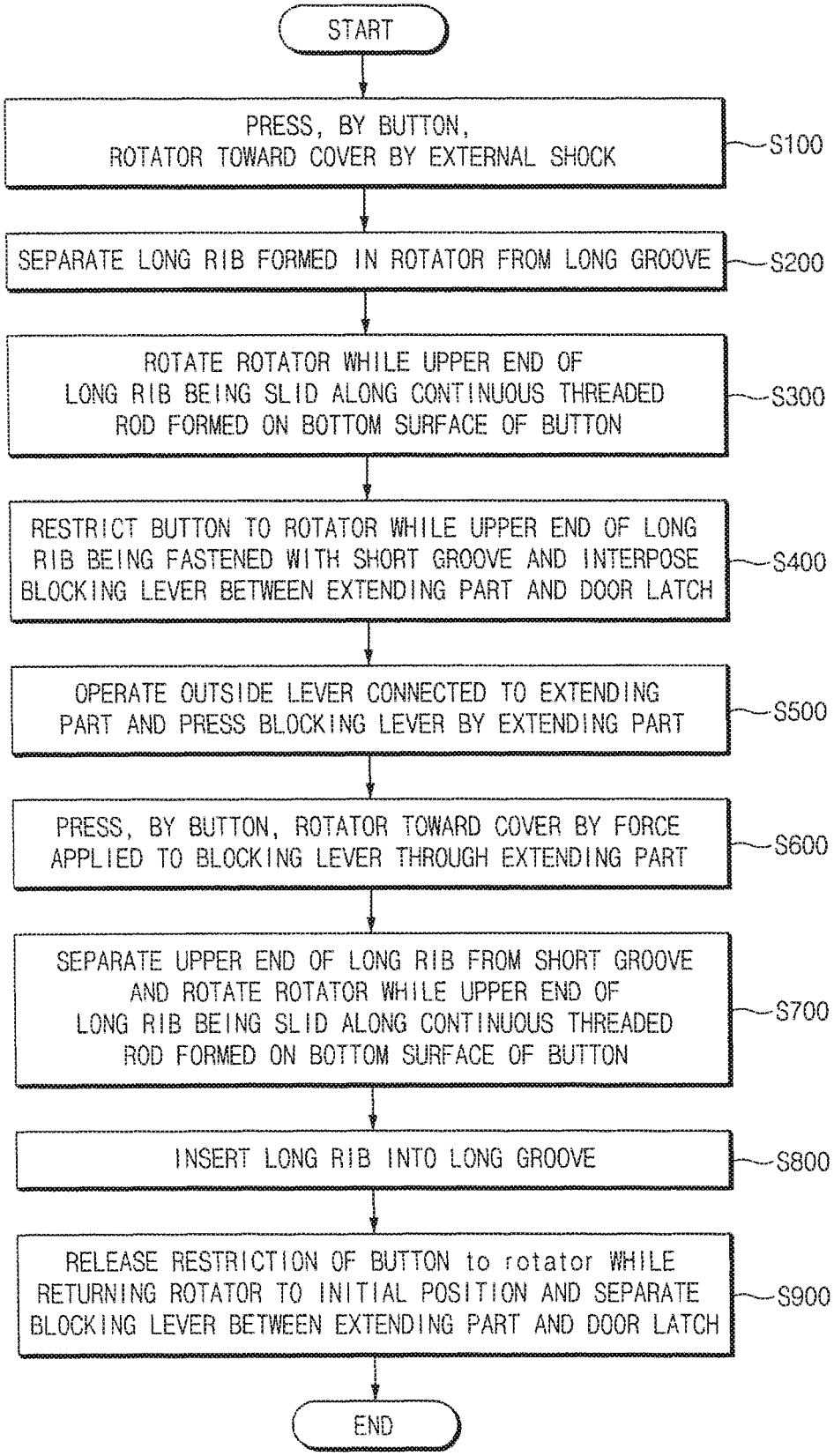
FIG. 8 is a flow chart of a method for preventing door from opening during a side collision according to an exemplary embodiment of the present inventive concept.
Figure 9A:
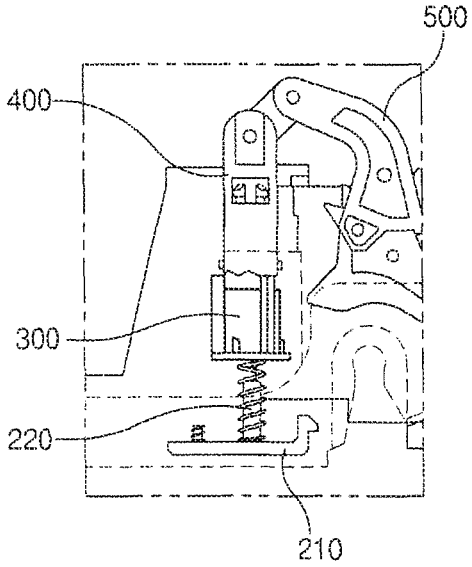
FIGS. 9A-9H are diagrams illustrating a state in which a blocking lever is operated according to the method for preventing a door from opening of FIG. 8.
Figure 9B:
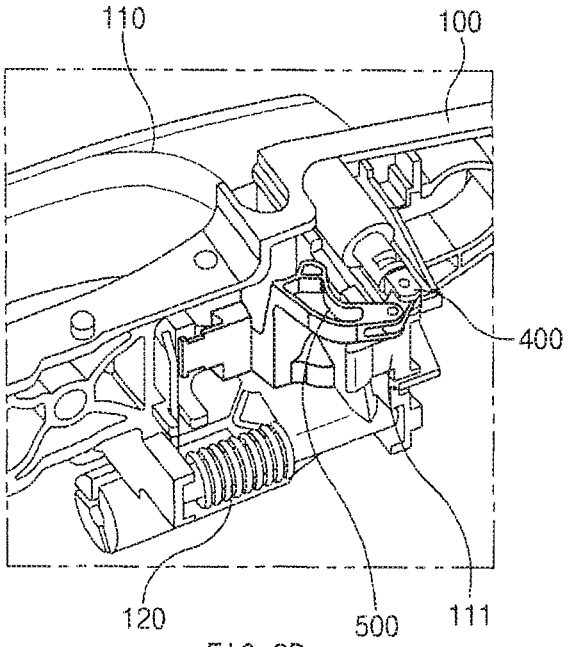
Figure 9C:
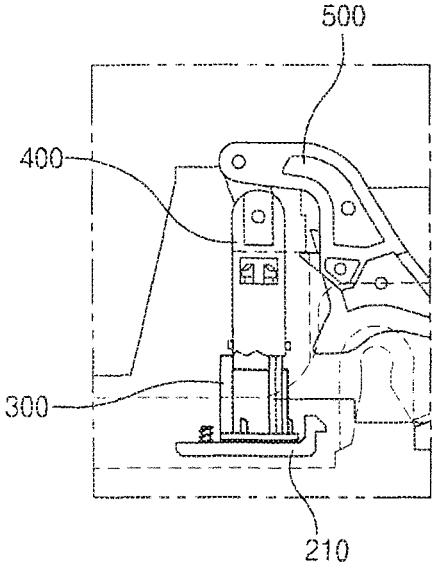
Figure 9D:
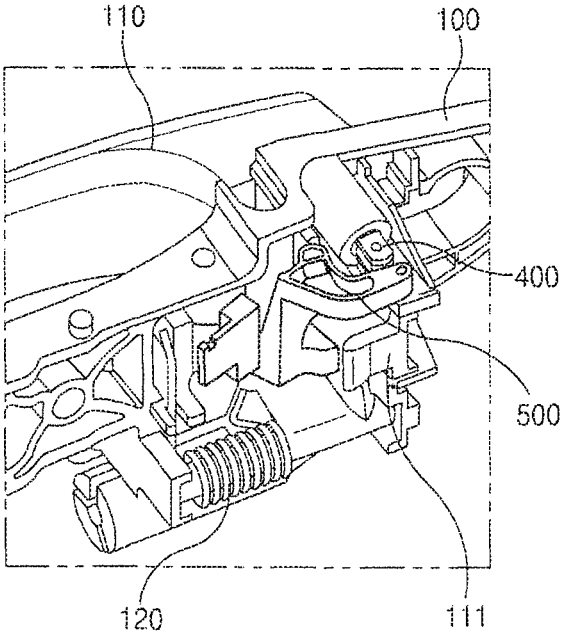
Figure 9E:
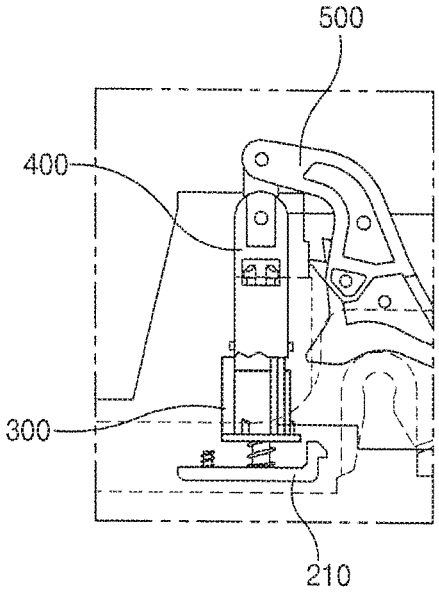
Figure 9F:
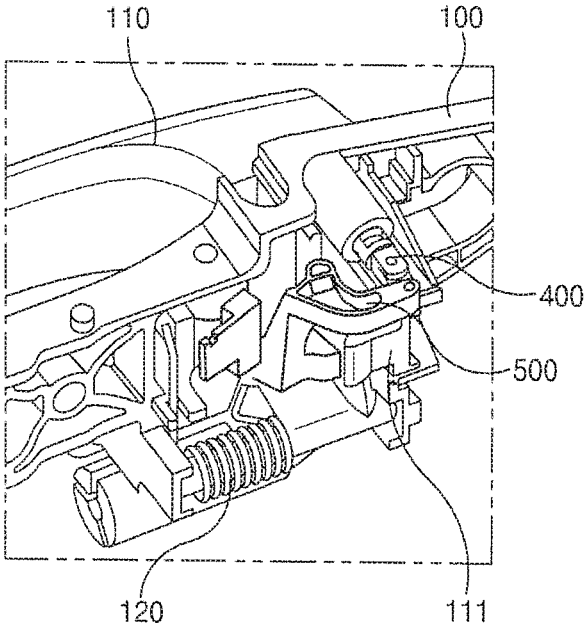
Figure 9G:
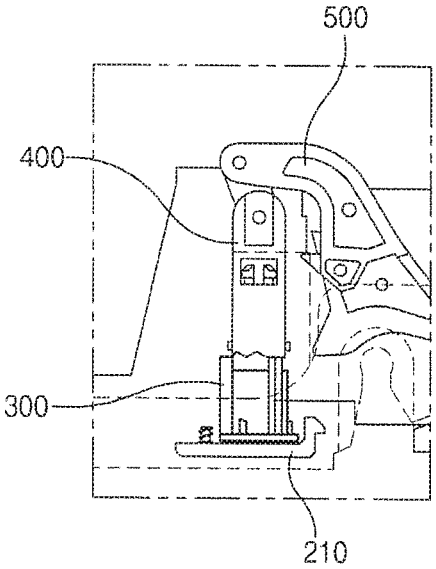
Figure 9H:
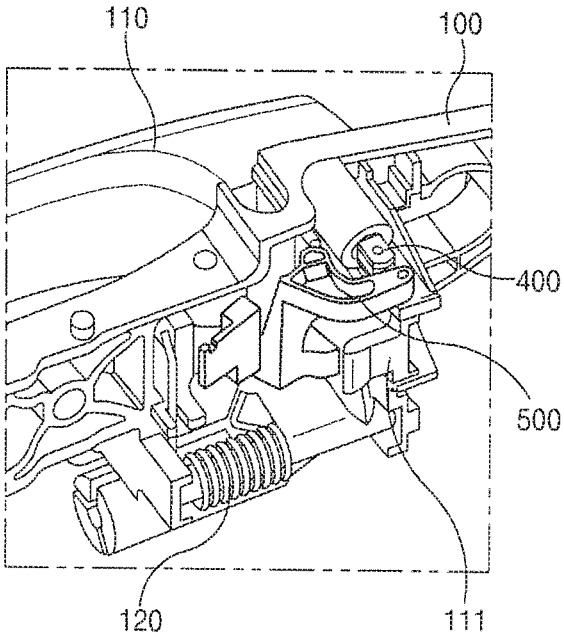

As illustrated in FIGS. 8-9H, a method for preventing a door from opening during a side collision according to an exemplary embodiment of the present inventive concept includes pressing the rotator 300 toward the cover 220 by the button 400 due to the external shocks (S100). The long rib 311 formed in the rotator 300 is separated from the long groove 231 (S200). The rotator 300 rotates while the upper end of the long rib 311 slides along the continuous cam surface 420 formed on the bottom surface of the button 400 (S300). The button 400 is restricted to the rotator 300 while the upper end of the long rib 311 is fastened with the short groove 232, and the blocking lever 500 is interposed between the extending part 111 and the door latch 120 (S400).

Further, the method for preventing a door from opening at the time of a side collision further includes operating the outside lever 110 connected to the extending part 111 and pressing blocking lever 500 by the extending part 111 (S500). The rotator 300 is pressed toward the cover 220 by a force applied to the blocking lever 500 through the extending part 111 by the button 400 (S600). The upper end of the long rib 311 is separated from the short groove 232, and the rotator 300 rotates while the upper end of the long rib 311 slides along the continuous cam surface 420 formed on the bottom surface of the button 400 (S700). The long rib 311 is inserted into the long groove 231 (S800). The restriction of the button 400 is released to the rotator 300 while the rotator 300 returns to the initial position, and the blocking lever 500 is separated between the extending part 111 and the door latch 120 (S900).

As described above, according to the door locking device and the method for preventing a door from opening at the time of a side collision in accordance with the exemplary embodiment of the present inventive concept, when the blocking lever is operated by the inertial force at the time of the collision, a position of the blocking lever is fixed, thus preventing the door from being unintentionally opened.

Further, when the collision situation ends, the outside lever moves the blocking lever to an original position, thus opening the door.

Hereinabove, although the present inventive concept has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A method for preventing a door from opening during a side collision of a vehicle having a door locking device, wherein the door locking device includes a base having an outside lever and a door latch, a guide part passing through the base, a button connected with a blocking lever, and a rotator mounted in the base and rotating by the button, the method comprising steps of:

pressing, by the button, the rotator while external load applied on the door is transferred to the button;

moving, by the button, the rotator so as to separate a long groove formed in the base while the button presses the rotator;

rotating, by the button, the rotator while an upper end of the long rib slides along a continuous threaded rod formed on a bottom surface of the button; and restricting, by the rotator, the button while the upper end of the long rib is engaged with a short groove formed in the base and the blocking lever is interposed between an extending part of the outside lever and the door latch, wherein outside lever is mounted on a surface of the base and the door latch is mounted on another surface of the base, the door latch contacting an extending part which protrudes on the another surface of the base, the guide part is parallel with the extending part, the guide part having an inner side part on which the long groove and a short are alternately formed and an internal area having an inner diameter larger than that of the inner side part, the rotator is inserted into the guide part, the rotator having the long rib inserted into the long grooves and a short rib inserted into the short groove, the button has a bottom surface, the bottom surface being in contact with the long rib, the button having a continuous cam surface having a regularly varying height, the blocking lever is connected to an upper end of the button and is pivotably mounted in the base, and an upper end of the long rib is slanted and adheres to the continuous cam surface of the button, and an upper end of the short rib has the same shape as the upper end of the long rib.

2. The method according to claim 1, further comprising step of:

operating the outside lever and pressing the blocking lever by the extending part;

pressing, by the button, the rotator by a force applied to the blocking lever through the extending part;

separating the upper end of the long rib from the short groove and rotating the rotator while the upper end of the long rib slides along the continuous threaded rod;

inserting the long rib into the long groove; and releasing the button to the rotator and separating the blocking lever between the extending part and the door latch.

* * * * *